US007055788B2

(12) United States Patent
Migli

(10) Patent No.: US 7,055,788 B2
(45) Date of Patent: Jun. 6, 2006

(54) SHELF-SUPPORTING DEVICE WITH RELEASABLE JAW FOR SHELF LOCKING

(75) Inventor: Carlo Migli, Lecco (IT)

(73) Assignee: Agostino Ferrari S.p.A. (IT)

( * ) Notice: Subject to any disclaimer, the term of this patent is extended or adjusted under 35 U.S.C. 154(b) by 0 days.

(21) Appl. No.: 10/808,076

(22) Filed: Mar. 24, 2004

(65) Prior Publication Data

US 2004/0232297 A1 Nov. 25, 2004

(30) Foreign Application Priority Data

Apr. 24, 2003 (IT) ..... MI20030199 U

(51) Int. Cl.
*E04G 3/08* (2006.01)

(52) U.S. Cl. ..... 248/239; 248/250

(58) Field of Classification Search ..... 248/250, 248/235, 239, 245, 902, 316.4, 316.6, 229.22, 248/229.24, 229.12; 108/108
See application file for complete search history.

(56) References Cited

U.S. PATENT DOCUMENTS 4,736,918 A * 4/1988 Bessinger ..... 248/250
4,736,919 A * 4/1988 Bessinger ..... 248/250
4,738,426 A * 4/1988 Bessinger ..... 248/250
2002/0166934 A1 * 11/2002 Marsh ..... 248/235

* cited by examiner

*Primary Examiner*—Ramon O Ramirez
(74) *Attorney, Agent, or Firm*—Shlesinger & Fitzsimmons

(57) ABSTRACT

A shelf-supporting device for furniture comprises a main body (11) designed to be secured to a shoulder of a piece of furniture to define a rest surface (32) for a shelf (15) to be supported, and a slidable jaw (17) facing the rest surface at the upper part thereof and designed to tighten the shelf against said rest surface. Fitting means (20, 21) is present between the slidable jaw (17) and main body (11) to keep the jaw to the desired tightening position. The device further comprises an operating button (23) that is kinematically connected with the fitting means (20, 21) for disengagement of same when pressure is exerted on the button itself (23) so as to enable free movement of the jaw at least away from the rest surface.

13 Claims, 2 Drawing Sheets

SHELF-SUPPORTING DEVICE WITH RELEASABLE JAW FOR SHELF LOCKING

BACKGROUND OF THE INVENTION

1. Field of the Invention

The present invention relates to an innovatory shelf-support of the type used in furniture to support shelves for example, in particular glass shelves.

2. State of the Prior Art

The shelf-fastening systems inside a piece of furniture in their simplest and elementary form consist of mere pins secured in appropriate holes formed in the lateral sides and jutting out at the inside of the piece of furniture, so as to constitute at least four coplanar and horizontal support points on which the shelf bears. It is apparent that while this form of fastening is unquestionably the cheapest possible one, it does not allow a particularly steady fastening: in fact the shelf secured in this manner is free to move upwardly or to slide in a forward direction. In particular, the shelf may slip forward losing its support and thus fall causing even serious damages.

To avoid this likelihood, shelf-support have already been proposed the projections of which in the inner space of the furniture are fastened into appropriate cavities formed in the side edges of the shelves: in this way fastening systems reacting to stresses having components in two or three directions can be obtained so that a much greater steadiness is achieved.

The necessity to make holes or cuts in the shelves however may constitute a serious limitation, above all in the case of panels of reduced thickness or working of which is difficult, as in the case of glass shelves. To obviate this drawback, shelf supports have been proposed in which in order to stabilize the shelf in a front direction, rest points are used that are covered with soft plastic materials having a high friction coefficient or shaped like small suction cups to improve grip on the glass. The most sophisticated articles of the known art also make use of a third element designed to lock the shelf against the rest surface at the upper part thereof, substantially forming a clamp trapping the shelf edge.

The last-mentioned devices however have the disadvantage that a lock means for the upper element is to be used. This lock means must be safe but at the same time cheap and it must allow easy release when the shelf is wished to be removed. In an attempt to meet this requirement, in the known art shelf supports have been proposed which are formed of a main body that is fitted by means of a suitable pin in a side hole in the shoulder of the piece of furniture. The horizontal shelf rests on an upper surface of the body of the shelf support, generally through interposition of a rubber element integral with the body itself. The shelf is maintained in place by an upper gripping element having a slider vertically slidable within the body. Suitable fitting elements are present between the slider and body. Generally these fitting elements are of the one-way type so as to enable sliding of the gripping element downwards against the upper surface of the shelf, but to prevent lifting of said element once in contact with the upper surface of the shelf. A problem in these known devices is however how to make fitting systems that are sufficiently cheap and reliable, while allowing easy release in case of need, above all when no tools are available.

It is a general aim of the present invention to obviate the above mentioned drawbacks by providing an innovative shelf support provided with a system for fastening of the slidable element to the body which allows a panel locking that is safe and at the same time of easy removal, all that with a reduced cost and high reliability.

SUMMARY OF THE INVENTION

In view of this aim, in accordance with the invention, a shelf-supporting device for furniture has been conceived that comprises a main body designed to be secured to a shoulder of a piece of furniture to define a rest surface for a shelf to be supported, and a slidable jaw facing the rest surface at the upper part thereof and designed to tighten the shelf against said rest surface, fitting means being present between the slidable jaw and main body to keep the jaw to a desired tightening position, characterized in that it comprises an operating button kinematically connected with the fitting means to disengage it when pressure is exerted on said button and allow free movement of the jaw at least away from the rest surface.

BRIEF DESCRIPTION OF THE DRAWINGS

For better explaining the innovative principles of the present invention and the advantages it offers over the known art, a possible embodiment applying said principles will be described hereinafter with the aid of the accompanying drawings. In the drawings.

DETAILED DESCRIPTION OF THE INVENTION

Figure 1:
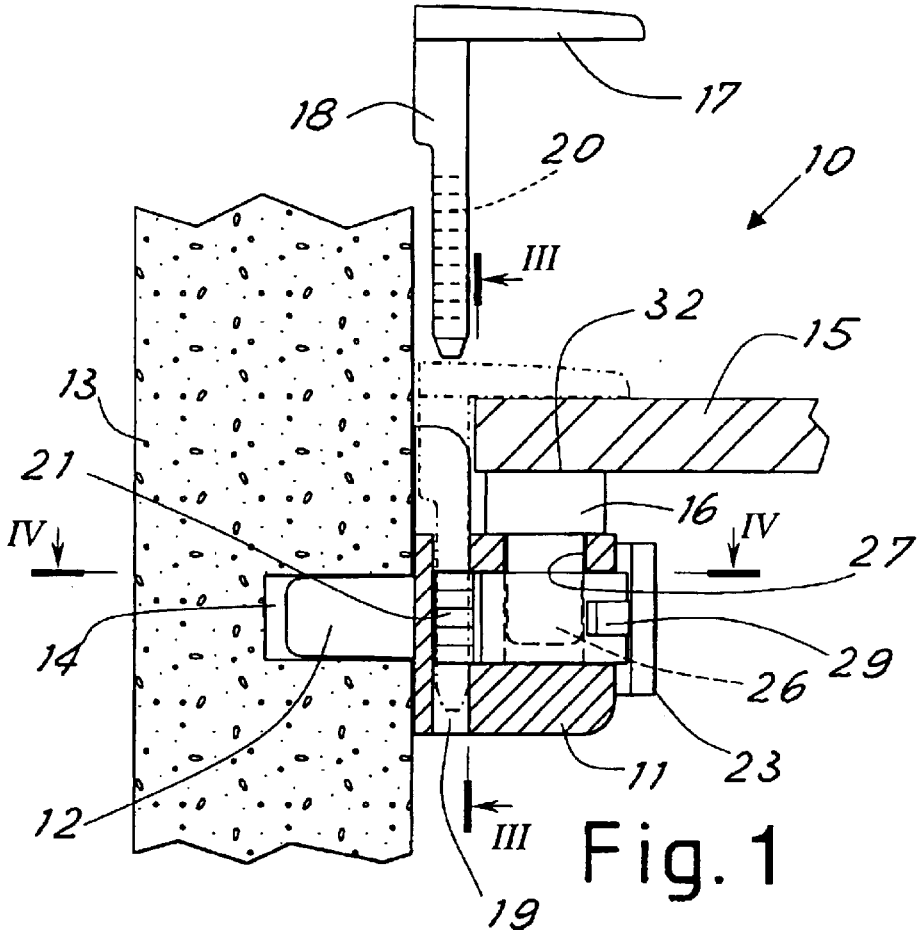
FIG. 1 is an exploded elevation side view, partly in section along line I—I in FIG. 2, of a shelf-supporting device in accordance with the invention.

With reference to the drawings, a shelf-supporting device is shown in FIG. 1 and generally denoted at 10. The device 10 comprises a body 11 having a fastening means 12 for mounting to a shoulder 13 of a piece of furniture. The fastening means is advantageously embodied by a pin 12 that is received in a suitable hole 14 in shoulder 13.

Figure 2:
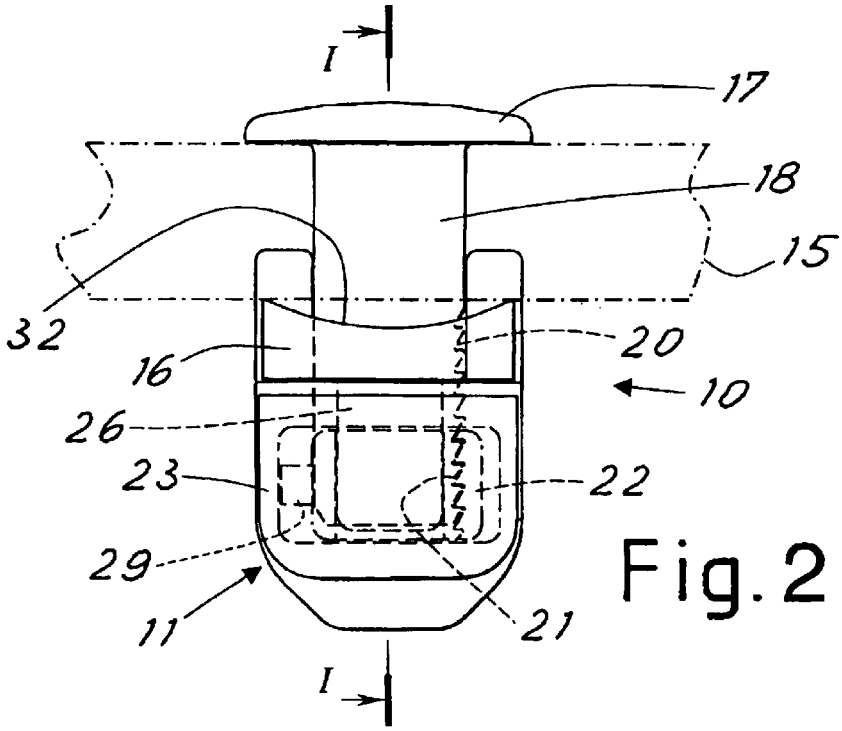
FIG. 2 is a front view of the device in FIG. 1.

The main body 11 comprises an upper surface 32 on which the edge of a shelf 15 rests. Advantageously, this surface consists of a shaped anti-slip rubber element 16, as shown in FIG. 2. In FIG. 2 said rubber element is in a non-squashed condition.

Figure 3:
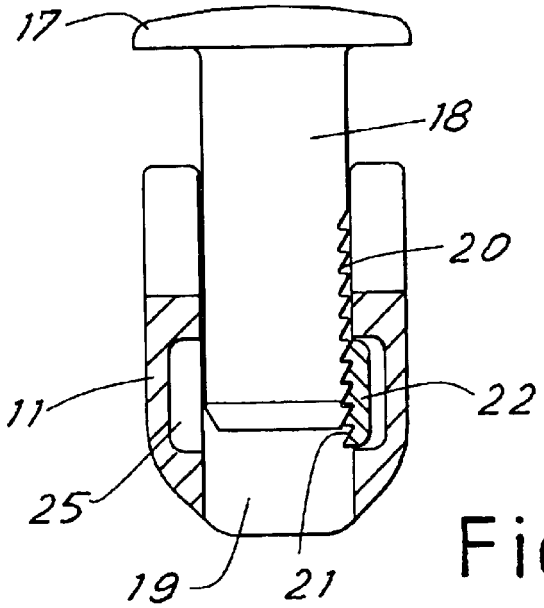
FIG. 3 is a view sectioned along line III—III in FIG. 1.

An upper lock jaw 17 is fitted in body 11 to stop the shelf on the body itself. As viewed from FIG. 1, the jaw 17 comprises a rod 18 projecting at the lower end thereof from the horizontal portion of the jaw to slidably enter a seat 19 present in the main body 11. The seat 19 is such made as to receive the rod 18 with a minimum side clearance, so that the jaw can slide vertically. Fitting means of the one-way type is present between body 11 and rod 18 to enable free sliding of the rod in the shelf-tightening direction (downwards in FIG. 1) but inhibiting free movement of the rod in the opposite direction. As clearly shown in FIG. 3, the one-way fitting means comprises a saw-toothed rack 20 on a side face of the rod 18 and complementary teeth 21 on a lock element 22 linked to body 11 in an elastically movable manner.

Figure 4:
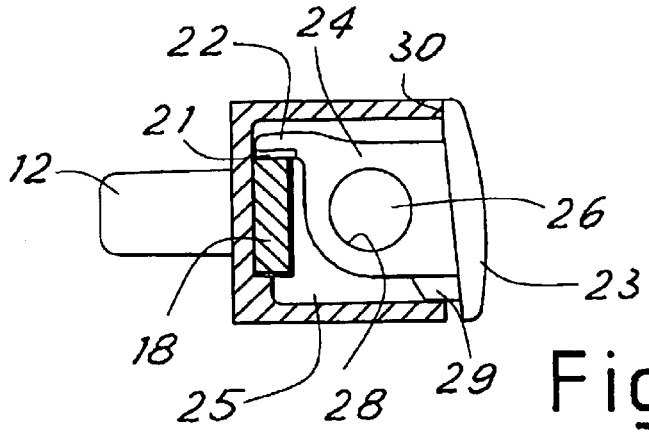
FIGS. 4 and 5 are views sectioned along line IV—IV in FIG. 1, showing the device in a working locked position and in an activated position for carrying out a free opening movement, respectively.
Figure 5:
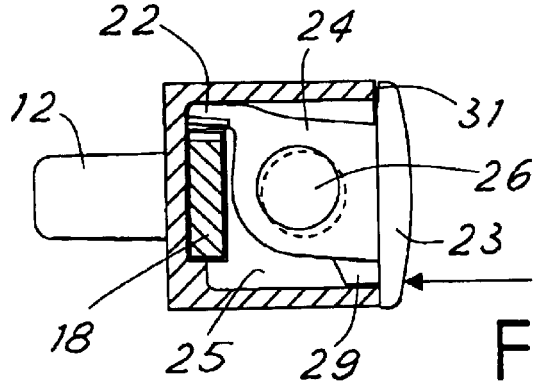

As shown in FIGS. 4 and 5, the lock element 22 has its teeth 21 elastically maintained in meshing relationship with the teeth 20 of the rod of the slidable jaw 17, and is kinematically connected with a release button 23 appearing at the outside of body 11. Advantageously, the button appears at the front of the body and under the rest surface of the shelf. This allows an easy operation also in case of a shelf-supporting device mounted close to the rear surface of the piece of furniture, for example.

For the sake of simplicity and cheap manufacture, the preferred kinematic connection between the fitting element 22 and the button is rigid, as shown in the figures. To make this rigid connection button 23 projects from an operating body 24 received in a chamber 25 present in body 11. The fitting element 22 in turn projects from the operating body 24 and is made in the form of a side arm. The operating body is centrally pivoted on the main body 11 of the shelf support so as to be rotatable when the button is pressed to move the toothed arm 22 away from the saw-toothed rack on rod 18.

In a preferred embodiment of the device, pivotal mounting of the operating body 24 is obtained by a pin 26 of elastic material (silicone rubber, for example) made of one piece construction with the rubber element 16 and also constituting the fitting foot of the rubber element on the body 11 of the shelf support. For the purpose, body 11 is bored at 27 at the upper part thereof to form a coaxial passage with a hole 28 in the operating body which receives the final end of the cylindrical pin 26 made with a diameter at least slightly bigger than hole 28 so as to keep a forced position therein. In a rest position the elastic pin keeps teeth 21 in meshing relationship with teeth 20 preventing upward sliding of the movable jaw. By virtue of the elastic yielding of the pin, movement of the rod in the opposite direction is on the contrary allowed. Reaction means is provided between button 23 and body 11 so that when the button is pressed the desired movement for disengagement of teeth 21 from teeth 20 occurs (against the elastic action of pin 26).

In the preferred embodiment the reaction means consists of a running block or tooth 29 laterally projecting from the operating body 24 to slide on an inner surface of chamber 25.

As clearly shown in FIG. 4, button 23 is suitably inclined relative to body 11 and on its end opposite to tooth 29 it has a flat 30 that is far from hole 28 approximately the same distance as that of hole 27 from the front surface or flat 31 of body 11.

If the pieces are suitably sized, in the situation of alignment of holes 27 and 28, surface 30 is in contact with flat 31, the running block 29 bears against the side wall of chamber 25 and the toothed surface 21 interferes with the toothed side surface of element 18, as shown in FIG. 4. By exerting pressure on the operating button 23 in the direction of the arrow in FIG. 5, the elastic resistance offered by the elastic pin 26 is easily overcome and the component 24 moves to the obliged position in FIG. 5 at which the operating button 23 is aligned with the rest surface 31, and running block 29—by sliding on the wall of chamber 25—has guided the side displacement in such a manner that the toothed surface 21 has become separated from the toothed surface 20 (shown in chain line in FIG. 5 is the elastic distortion of the pin).

At this point jaw 17 can freely move in both directions and therefore can be easily extracted to make shelf 15 free.

At this point it is apparent that the intended purposes have been reached by providing a shelf support of simple structure ensuring a safe fitting of the supported shelf and at the same time allowing an easy and quick release when wished. With the preferred solution herein described the shelf support consists of only three pieces and can be easily embodied by a main body, a button and a slidable jaw of metal material.

Obviously, the above description of an embodiment applying the innovative principles of the present invention is given by way of example only and therefore must not be considered as a limitation of the scope of the patent rights herein claimed. For example, the shape and proportion of the different parts can vary depending on requirements. In addition, if wished, the operating button can appear at another position and/or the fitting teeth can be disposed on another face of the rod, on the front face of greater extension for example.

What is claimed is:

1. A shelf support for furniture, comprising a main body designed to be secured to a shoulder of a piece of furniture to define a rest surface on which a shelf can be supported, and a slidable jaw facing the rest surface at an upper part thereof arid designed to tighten a shelf against said rest surface, fitting means being present between the slidable jaw and main body to keep the jaw to a desired tightening position, characterized in that the shelf support comprises an operating button kinematically connected with the fitting means to release the fitting means when the button is pressed and allow free movement of the jaw at least away from the rest surface.

2. A shelf support as claimed in claim 1, characterized in that the fitting means is of the one-way type and allows free movement of the jaw in a direction toward the rest surface.

3. A shelf support as claimed in claim 2, characterized in that the jaw is slidable on the main body by means of a rod projecting from a lower part of the jaw and slidably inserted in a seat in the main body, said fitting means being disposed between the rod and said main body.

4. A shelf support as claimed in claim 3, characterized in that the fitting means comprises a saw-toothed rack on a side face of the rod and complementary teeth provided on a lock element fastened to the main body and elastically movable between a position at which the lock element teeth are fitted in the rack and a release position in which the lock element teeth are disengaged from the rack.

5. A shelf support as claimed in claim 4, characterized in that the lock element is pivotally mounted on the main body by means of an elastic pin made unitary with an anti-slip rubber element coveting said rest surface for the shelf.

6. A shelf support as claimed in claim 5, characterized in that the pin also represents a restrained attachment point for the rubber element in the main body.

7. A shelf support as claimed in claim 4, characterized in that the button is rigidly linked to an operating body received and pivotally mounted in a corresponding chamber in the main body and embodying said lock element with its projection provided with said fitting teeth in the rack, on pressing the button the operating body moving along the pivotally mounted pin to disengage said teeth from the rack.

8. A shelf support as claimed in claim 7, characterized in that between the operating body and main body reaction means act in such a manner that on pressing the button the operating body is displaced against the elastic action of the pin to disengage the teeth from the rack.

9. A shelf support as claimed in claim 8, characterized in that the reaction means comprises a running block laterally projecting from the operating body to slide on an inner surface of the chamber when the button is pressed.

10. A shelf support as claimed in claim 9, characterized in that the button is inclined to the main body and has a rest surface on the main body on an end of the button opposite to said running block.

11. A shelf support as claimed in claim 10, characterized in that the operating body is provided with a pivot hole receiving said elastic pin entering the pivot hole through a corresponding hole in the main body, and in that said rest surface of the button has a distance from said pivot hole in the operating body that is about the same as the distance of said corresponding hole in the main body from the surface of the main body on which said surface of the button bears.

12. A shelf support as claimed in claim 11, characterized in that the button is at a front on said main body and is disposed under the rest surface.

13. A shelf support as claimed in claim 12, characterized in that on the opposite side from said button the main body is provided with a pin designed to fit in a seat formed in the shoulder of the piece of furniture.

* * * * *